US009427029B2

(12) United States Patent
Castellano

(10) Patent No.: US 9,427,029 B2
(45) Date of Patent: Aug. 30, 2016

(54) GARMENT HAVING ZONES WITH VARYING SHAPE CONTROL CHARACTERISTICS

(71) Applicant: Maidenform LLC, Winston-Salem, NC (US)

(72) Inventor: Steven Castellano, Middletown, NJ (US)

(73) Assignee: MAIDENFORM LLC, Winston-Salem, NC (US)

( * ) Notice: Subject to any disclaimer, the term of this patent is extended or adjusted under 35 U.S.C. 154(b) by 522 days.

(21) Appl. No.: 13/835,140

(22) Filed: Mar. 15, 2013

(65) Prior Publication Data

US 2014/0273744 A1 Sep. 18, 2014

(51) Int. Cl.
*A41B 9/00* (2006.01)
*A41B 17/00* (2006.01)

(52) U.S. Cl.
CPC ..... *A41B 17/00* (2013.01); *A41B 9/00* (2013.01); *A41B 2400/38* (2013.01); *A41B 2500/10* (2013.01)

(58) Field of Classification Search
CPC ..... A41C 1/00; A41D 2300/22; A41B 9/00
USPC ..... 450/94, 97, 100, 101, 109, 116–118, 450/122–124
See application file for complete search history.

(56) References Cited

U.S. PATENT DOCUMENTS

| | | | | |
|---|---|---|---|---|
| 4,701,964 | A * | 10/1987 | Prunesti | A41C 1/003 2/406 |
| 5,447,462 | A * | 9/1995 | Smith | A41C 1/003 2/73 |
| 5,916,829 | A * | 6/1999 | Girard | A41C 5/00 442/182 |
| 6,276,175 | B1 * | 8/2001 | Browder, Jr. | 66/171 |
| 7,024,892 | B2 | 4/2006 | Blakely | |
| 7,260,961 | B1 * | 8/2007 | Kennedy | 66/177 |
| 2002/0152775 | A1 * | 10/2002 | Browder, Jr. | 66/170 |
| 2003/0140661 | A1 * | 7/2003 | Bonnin | 66/170 |
| 2003/0192351 | A1 * | 10/2003 | Meckley et al. | 66/170 |
| 2003/0196252 | A1 * | 10/2003 | Blakely | 2/400 |
| 2007/0032771 | A1 * | 2/2007 | Abed et al. | 604/385.22 |
| 2011/0179555 | A1 * | 7/2011 | Bickley et al. | 2/401 |
| 2012/0192595 | A1 * | 8/2012 | Waldman et al. | 66/175 |

* cited by examiner

*Primary Examiner* — Gloria Hale
(74) *Attorney, Agent, or Firm* — Fish & Richardson P.C.

(57) ABSTRACT

A garment that includes a first shape control material layer and a second shape control material layer fused to the first shape control layer. The first shape control material layer has a first degree of stretch and is shaped in a basic garment shape. The second shape control material layer has a second degree of stretch and is shaped to correspond to a portion of a wearer's body that is less than that covered by the first shape control material layer.

21 Claims, 2 Drawing Sheets

GARMENT HAVING ZONES WITH VARYING SHAPE CONTROL CHARACTERISTICS

FIELD OF THE INVENTION

The present invention relates to garments that include targeted shape control zones.

BACKGROUND OF THE INVENTION

Many women have parts of their bodies that they are unhappy with, making them have an insecure feeling when wearing certain clothing. Foundation garments have been worn for a very long time to address this problem. Better known today as shapewear, these foundation garments include body briefs, bodysuits, brassieres, control top panty hose, control panties, control briefs, control slips, control camisoles, control tanks, hip slips, waist shapers, corsets, garter belts, and girdles.

Shapewear are undergarments designed to change the wearer's shape, producing a more fashionable, slim figure and to enhance the natural curves of the body. Take for example control briefs. They are designed to lift a wearer's bottom, flatten the tummy and add shape and form to the thighs.

Shapewear is typically categorized according to the level or shape control offered—for instance, light, medium or firm. Generally, shapewear can be categorized into four different support levels:

- Light Control shapewear garments, which offer a slight touch of control without binding. These are typically chosen by women of all sizes who want to appear firmer, but not necessarily smaller.
- Moderate Control shapewear garments may have light control panels built in, offering control with a touch of compression. These are typically chosen by women who want to look more toned.
- Firm Control shapewear garments are the most popular with a support level that gives the maximum amount of compression and control. These are typically chosen by women seeking to appear slimmer and more toned.

Extra Firm Control shapewear garments offer the highest level of support. These garments will most likely have reinforced panels and possibly boning.

Shapewear garments typically have a single control material covering an entire section of the garment. For example, in a typical shapewear panty, a single control panel material forms the tummy, thigh and buttocks areas of the garment. This results in a shapewear garment that has the same control properties for all sections of the garment. This may ultimately result in a garment that provides a desired amount of control in one area, while providing too much or too little control in another area. As a typical problem with such panty garments, a wearer may end up with a good control in the thigh and tummy area, but the panty provides too much control and/or compression in the buttocks area. This results in the wearer having the undesirable appearance of a "flat" buttocks.

SUMMARY OF THE INVENTION

The present invention provides a shapewear garment that is capable of delivering different shape control properties to different regions of a wearer's body. The garment includes a single layer of a shape control material to form the basic garment shape, and then an overlay of a further layer of shape control material in sections of the garment where increased shape control is desired, so as to thereby produce a garment having zones that provide varying degrees of stretch.

One aspect of the present invention is configured as panties, boy shorts, briefs or thigh slimmers. In this aspect, the garment is formed from a first shape control layer that imparts a desired degree of overall stretch to the wearer. The garment is then provided with a tummy/midriff layer and/or two opposed lateral side layers that correspond to and cover portions of the thighs/hips of the wearer while not covering the buttocks area of the wearer. With such a configuration, the buttocks area of the wearer can be provided with less of a control and/or compression, thereby reducing the "flat" buttocks appearance.

The materials for the various layers of the garment are selected to provide a desired degree of shaping for the corresponding body part at the particular location. In the panty, boy short, brief and thigh slimmer configurations, the material used for the tummy/midriff layer and lateral side panel layers preferably have the same or a greater degree of stretch than the material used for the overall garment layer, thereby providing a greater degree of restriction and shaping in the tummy/midriff and thigh/hip areas for the wearer.

Further, it is preferred that the additional layers of material attached to the first layer forming the basic garment shape are secured without stitching or seams. Preferably, the additional layers are fused along their edges to an inside surface of the basic garment shape to form semi-rigid panels.

It is also preferred that various garments be formed from a tubular knitted material that is cut and folded to form the various overlapping sections of the garment, and then the overlapping sections are fused to form the various multiple layer zones of the garment.

BRIEF DESCRIPTION OF THE DRAWINGS

The figures are for illustration purposes only and are not necessarily drawn to scale. The invention itself, however, may best be understood by reference to the detailed description which follows when taken in conjunction with the accompanying drawings in which.

DESCRIPTION OF THE INVENTION

The present invention will next be illustrated with reference to the figures. Such figures are intended to be illustrative rather than limiting and are included herewith to facilitate the explanation of exemplary features of the present invention. Unless otherwise noted, the figures are not to scale, and are not intended to serve as engineering drawings.

Figure 1:
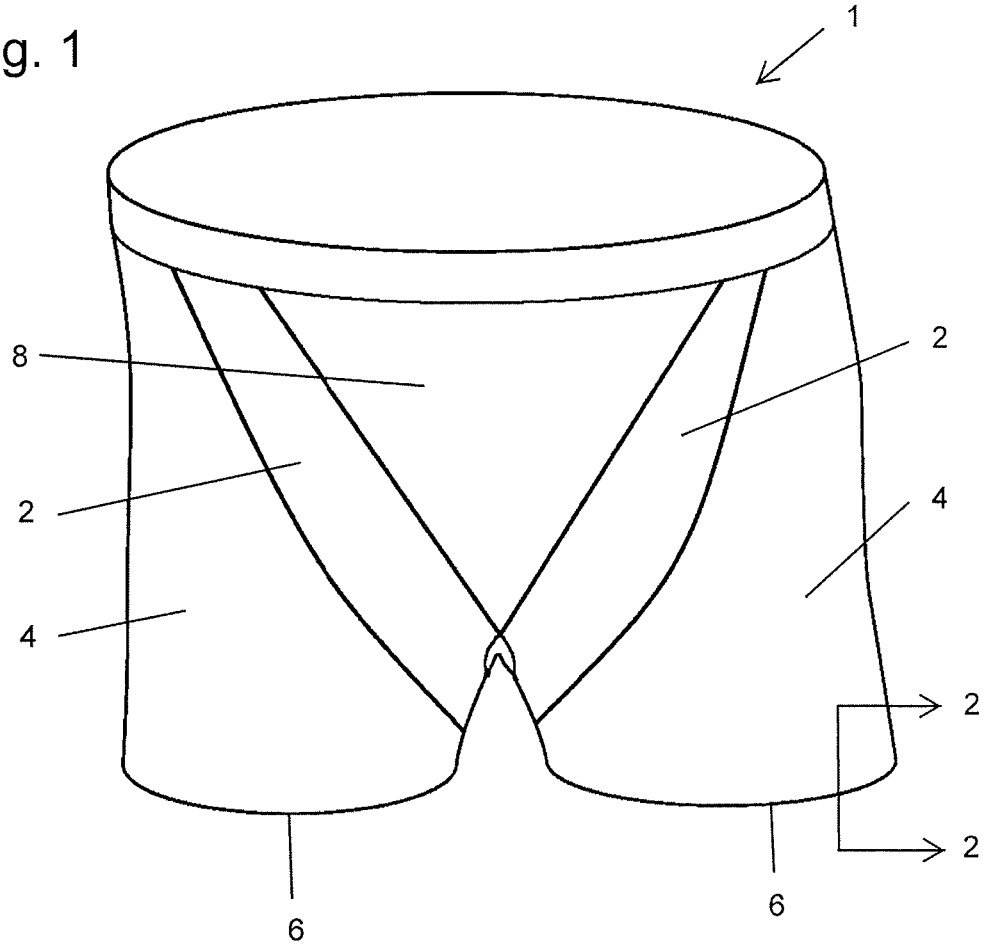
FIG. 1 is a plan view of an inner front side of a garment according to one aspect of the present invention.
Figure 2:
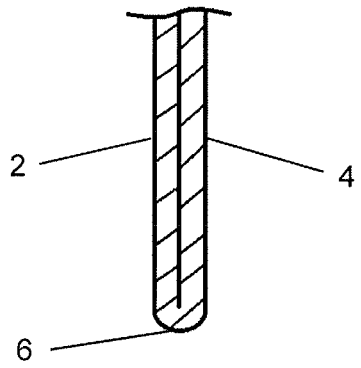
FIG. 2 is a cross section of line 2-2 in FIG. 1.
Figure 3:
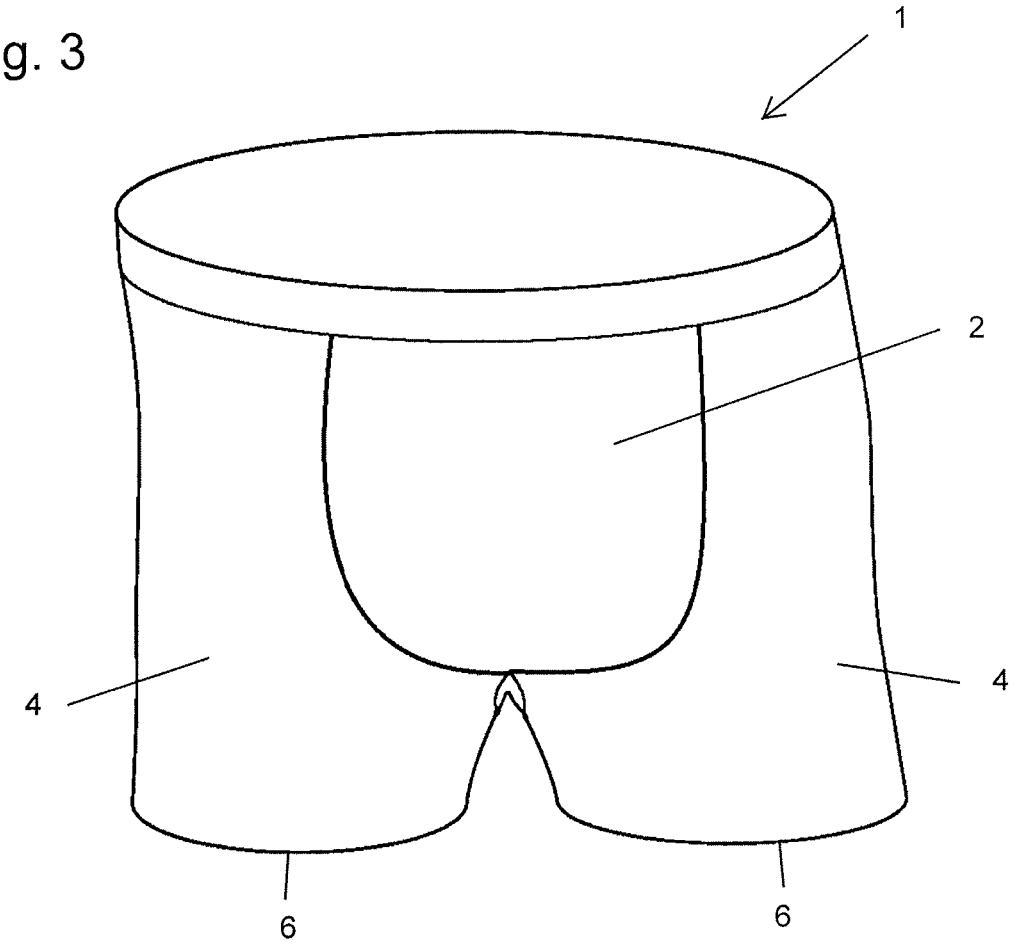
FIG. 3 is a plan view of an inner rear side of the garment of FIG. 1.

Referring now to FIGS. 1-3, a garment 1 according to a first aspect of the present invention is shown. It should be noted that FIGS. 1 and 3 depict the inner, body facing surface of the garment 1. In the preferred configuration, the outer, non-body facing surface will appear smooth and seamless, as described in further detail herein. The garment 1 includes a first shape control material layer 2 having a first degree of stretch and shaped in a basic garment shape. As shown in FIGS. 1 and 3, the basic garment shape for the first aspect of the present invention is panties, boy shorts or thigh slimmers. A second shape control material layer 4 is coupled to the first shape control layer 2. The second shape control layer 4 has a second degree of stretch and is shaped to correspond to a portion of a wearer's body that is less than that covered by the first shape control material layer 1. For example, as shown in FIGS. 1 and 3, the second shape control material layer 4 covers the thigh/hip area of the wearer and not the tummy/midriff or buttocks area.

Preferably, the second shape control material layer 4 is coupled to the body-facing surface of the first shape control material layer 2, and done so without the use of a seam or stitching. Preferably, this is accomplished by thermally fusing the layers together, techniques for which are known in the art. It is contemplated that the first and second shape control material layers can be attached to each other by sewing or any other means known in the art to attach fabric materials together.

In the preferred configuration, the first shape control material layer 2 and the second shape control material layer 4 are knitted tubular materials. That is, when constructing the garment shown in FIGS. 1 and 3, it is preferred that a tubular knit material be formed, and then the tubular knit is cut the have the desired shaping for the particular garment being formed, in this case panties, boy shorts, briefs or thigh slimmers. After the tubular knitted material is cut into the desired shape, the corresponding portions of the cut material are folded over each other and fused together. As shown in FIG. 2, this then creates a shared common folded edge 6 between the first shape control material layer 2 and the second shape control material layer 4.

Because it is preferred to use a tubular knitted material that is cut into the desired shape, folded and fused, it is also preferred therefore that the first shape control material layer 2 and the second shape control material layer 4 are the same material and have the same degree of stretch properties. By having the second shape control material layer 4 not overlap all portions of the first shape control material layer 2, zones of multiple layers are created that provide different degrees of shape control for the wearer.

As will be appreciated by one of skill in the art reviewing the present disclosure, it is possible and contemplated that the second shape control material layer 4 will be made from a different material that is not the same tubular knitted material as the first shape control material layer 2. By doing so, a garment wherein the first shape control material layer 2 and the second shape control material layer 4 are different materials and have different degree of stretch properties can be formed. In such a configuration, it is preferred that the second shape control material layer 4 is coupled to the body-facing surface of the first shape control material layer 2 without the use of a seam or stitching. Preferably, this is accomplished by thermally fusing the layers together, techniques for which are known in the art. It is also contemplated, however, that the first and second shape control material layers 2, 4 can be attached to each other by sewing or any other means known in the art to attach fabric materials together. It will also be evident from the present disclosure that when the first and second shape control material layers 2, 4 are made from separate or different materials attached together, a common folded edge will not be present.

With particular reference to FIG. 3, the preferred shaping of the second shape control material layer 4 is such that the buttocks area of the wearer is only covered by the first shape control material layer 2. This allows for the buttocks area to have a lesser degree of compression than the portions of the garment 1 where the first and second shape control material layers 2, 4 overlap, and thus reducing "flat" buttocks appearance typically associated with shapewear garments.

Returning now to FIG. 1, in certain configurations it may be desirable to include a third shape control material layer 8 corresponding to the tummy/midriff area of the user. As shown in FIG. 1, it is preferred that the third shape control material layer 8 is coupled to the body facing surface of the first shape control material layer 2 in a location where the second shape control material layer 4 is not provided. Similar to the second shape control material layer 4, the third shape control material layer 8 can be formed from the same tubular knitted material as the first shape control material layer 2, or can be formed separately from a different material. Thus, the third shape control material layer 8 can have the same or different degree of stretch characteristics as the other shape control material layers 2, 4. If the third shape control material layer 8 is formed from the same tubular knitted material as the first shape control material layer 2, it is also preferred that the first shape control material layer 2 and the third shape control material layer 8 share a common folded edge 6 and be seamlessly coupled to each other.

The material for the first, second and third shape control material layers 2, 4 and 8 can be any blend of natural or synthetic fibers, including but not limited to, cotton/spandex, polyester/spandex, nylon/spandex, modal, viscose, acrylic, PTT, or any other material or combination of materials that can provide the desired control and/or compression. For example, the material can be a stretch mesh fabric having a weight of 75 g/m$^2$, and a 180% length/85% width elongation under a 10 lb. load, a stretch tricot material, a cotton/spandex knit material or a poly/spandex knit material having a weight 125-180 g/m$^2$, and a 75-270% length/100-150% width elongation under a 10 lb. load. The selection of any particular material will depend on such factors as wearability characteristics, comfortable stretch properties, and a modulus of elasticity that assists in the overall smoothing appearance of the wearer's body.

It should be noted that although the number of layers of material in the presently preferred configurations of the garments has been described herein with respect to a particular number of layers, the actual number of layers in the garment may vary based on specific requirements of the garment being constructed, such as for a particular weight garment for a certain season of use. Accordingly, the number of layers of material shown in the garment of FIGS. 1-3 is merely illustrative and in no way excludes other combinations of layers that may be employed by one of ordinary skill in the art to achieve the benefits of the present invention.

Although the present invention has been described in relation to particular aspects thereof, many other variations and modifications will become apparent to those skilled in the art. As such, it will be readily evident to one of skill in the art based on the detailed description of the presently preferred configurations of the garments explained herein, that different types of garments can be realized.

What is claimed is:

1. A garment comprising:

a first shape control material layer having a first degree of stretch and shaped in a basic garment shape to define a body of the garment; and a second shape control material layer overlapping a portion of a surface of the first shape control material layer and fused to the first shape control material layer along at least a portion of a periphery of the second shape control material layer, wherein the second shape control material layer is fused to the first shape control material layer only adjacent peripheral edges of the second shape control material layer, the second shape control material layer having a second degree of stretch and shaped to correspond to a portion of a wearer's body that is less than that covered by the first shape control material layer, wherein the second shape control material layer defines a portion of the body of the garment that is less than the body of the garment defined by the first shape control material layer.

2. The garment according to claim 1, wherein the second degree of stretch is different than the first degree of stretch.

3. The garment according to claim 1, wherein the second degree of stretch is the same as the first degree of stretch.

4. The garment according to claim 1, wherein the first shape control material layer and the second shape control material layer comprise the same material.

5. The garment according to claim 4, wherein the first shape control material layer and the second shape control material layer are formed from knitted tubular materials.

6. The garment according to claim 4, wherein the first shape control material layer and the second shape control material layer are formed from a single knitted tubular material, wherein the first shape control material layer and the second shape control material layer share a common folded edge.

7. The garment according to claim 1, wherein the second shape control material layer is fused adjacent its peripheral edges to a body-facing surface of the first shape control material layer.

8. The garment according to claim 1, wherein the second shape control material layer is seamlessly coupled to a body-facing surface of the first shape control material layer.

9. The garment according to claim 1, further comprising a third shape control material layer fused to the first shape control material layer only adjacent peripheral edges of the third shape control material layer and in a location on the surface of the first shape control material layer free from overlap of the second shape control material layer, the third shape control material layer having a third degree of stretch.

10. The garment according to claim 9, wherein the third degree of stretch is different than the first degree of stretch.

11. The garment according to claim 9, wherein the third degree of stretch is the same as the first degree of stretch.

12. The garment according to claim 9, wherein the first shape control material layer, the second shape control material layer and the third shape control material layer are different materials.

13. The garment according to claim 9, wherein the first shape control material layer, the second shape control material layer and the third shape control material layer are the same material.

14. The garment according to claim 13, wherein the first shape control material layer and the third shape control material layer are knitted tubular materials.

15. The garment according to claim 13, wherein the first shape control material layer and the third shape control material layer are knitted tubular materials that share a common folded edge.

16. The garment according to claim 9, wherein the third shape control material layer is coupled to a body-facing surface of the first shape control material layer.

17. The garment according to claim 9, wherein the third shape control material layer is seamlessly coupled to a body-facing surface of the first shape control material layer.

18. The garment according to claim 1, wherein the garment is configured as panties, boy shorts, briefs or thigh slimmers.

19. The garment according to claim 18, wherein the second shape control material layer is configured so as to not cover a wearer's buttocks area.

20. The garment according to claim 1, wherein the first shape control material layer and the second shape control material layer are different materials.

21. The garment of claim 1, wherein the second shape control material layer is secured to the first shape control material layer without stitching or seams.

* * * * *